United States Patent [19]

Chapin

[11] 3,945,210

[45] Mar. 23, 1976

[54] ENERGY RECOVERY

[75] Inventor: Bryan W. Chapin, Union Springs, N.Y.

[73] Assignee: Rodina Energy R & D Corporation, Auburn, N.Y.

[22] Filed: June 7, 1974

[21] Appl. No.: 477,207

[52] U.S. Cl. ..... 60/618; 60/655; 62/467 R

[51] Int. Cl.[2] ..... F01K 23/06

[58] Field of Search ..... 60/597, 614, 615, 618, 60/655, 651, 671; 62/467

[56] References Cited

UNITED STATES PATENTS

| | | | |
|---|---|---|---|
| 665,912 | 1/1901 | Jolicard | 122/501 |
| 2,273,767 | 2/1942 | Upton | 122/501 X |
| 3,043,763 | 7/1962 | Spillmann | 60/655 X |
| 3,228,189 | 1/1966 | Baker | 60/618 |
| 3,259,176 | 7/1966 | Rice et al. | 62/467 |
| 3,589,436 | 6/1971 | Anderson | 62/467 X |
| 3,830,062 | 8/1974 | Morgan et al. | 60/618 |

*Primary Examiner*—Allen M. Ostrager
*Attorney, Agent, or Firm*—Strauch, Nolan, Neale, Nies & Kurz

[57] ABSTRACT

System for recovering waste heat energy produced by an internal combustion engine or other waste heat source. Heat energy present in the engine coolant or engine exhaust is used as a power source for a closed secondary power circuit operating on the Rankine cycle. The secondary power circuit incorporates a high efficiency compact evaporator system.

5 Claims, 3 Drawing Figures

ENERGY RECOVERY

BACKGROUND OF THE INVENTION

As is well known, only a small fraction of the energy developed in an internal combustion engine such as a piston engine, now in practically universal use in automotive applications, produces usable shaft horsepower. The major portion of the energy is dissipated to the atmosphere through the engine coolant system or the engine exhaust system.

In the past, many attempts have been made to reduce these losses or to convert the otherwise wasted energy to useful form, often by using the waste heat as a power source for a secondary power system. Examples of such prior proposals are disclosed in U.S. Pat. Nos. 3,228,189 and 3,479,817.

As far as is known, neither proposal nor other proposals of a similar nature have been used on a commercial scale. It is believed that the failure of the industry to adopt these proposals and similar proposals is due to their complexity, cost, lack of reliability, and the physical bulk of the equipment which renders their use, particularly in automotive applications, impractical.

SUMMARY OF THE INVENTION

With the foregoing considerations in mind, it is the principal purpose and object of the present invention to provide improved secondary power systems for recovering waste energy produced by a primary power system such as an automobile engine, the secondary power system being mechanically uncomplicated, relatively inexpensive and of sufficiently compact construction to permit its installation in the engine compartment of a conventional automobile where space limitations may be quite severe.

It is further object of the present invention to provide improved apparatus for evaporating the motive fluid in a Rankine cycle power system which, for a given size, has substantially increased capacity and efficiency.

While the invention in certain aspects is of general application and broad utility, it is expected that its principal utility may reside in its use to recover the waste heat energy produced by a conventional automobile engine.

In such an application, the invention comprises a closed circuit power system operating on the Rankine cycle and preferably using as a motive fluid a refrigerant such as FREON 11.

The fluid is superheated and evaporated utilizing the heat of the engine coolant or engine exhaust or both, the fluid in gaseous state being delivered to a fluid motor and then to a condenser for return to the evaporator through a pump. Preferably the power produced by the motor is returned to the engine by a direct mechanical connection between the motor and the engine.

Optionally, the secondary power system is also utilized to provide the vehicle air conditioning thus providing greater overall operating efficiency. An important component of the secondary power system of the present invention is an evaporator and capillary control system described in detail below.

Additional advantages of the present invention will appear as the description proceeds.

THE DRAWINGS

DESCRIPTION OF PREFERRED EMBODIMENTS

Figure 1:
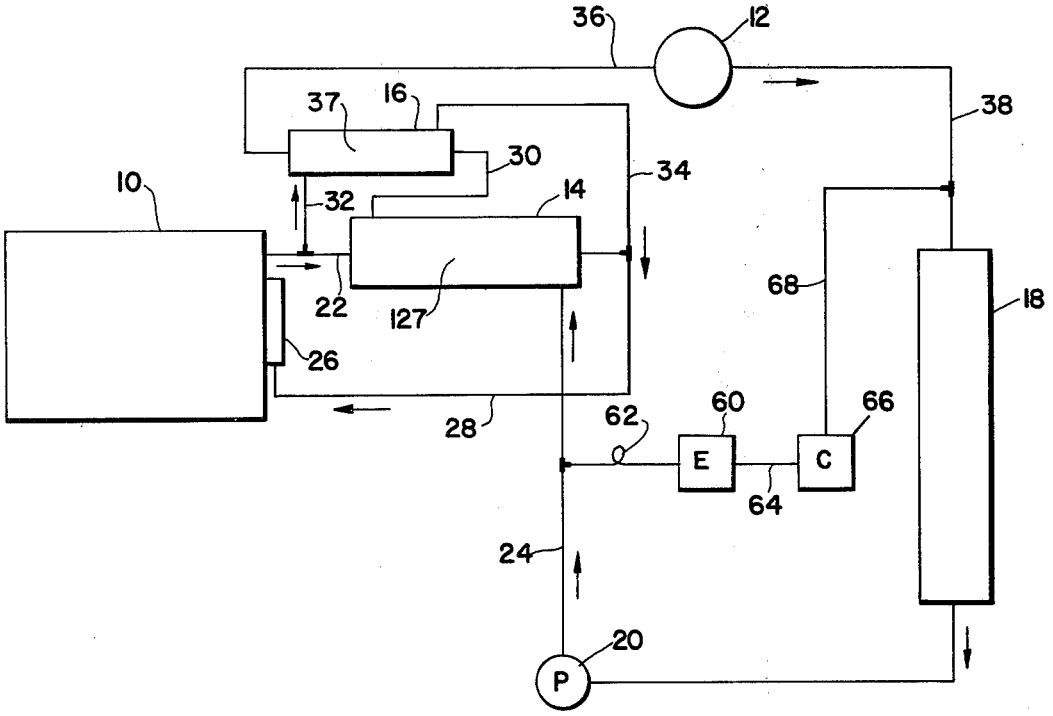
FIG. 1 illustrates schematically a typical application of the system of the present invention in association with an automobile engine.

FIG. 1 illustrates a typical embodiment of the invention in which the heat energy of the coolant in a conventional automobile engine 10 is utilized to drive a motor 12 to return power to the engine 10 to assist the engine in driving its load. In addition to the motor 12, which may be of any conventional construction, the system comprises a closed circuit containing a motive fluid such as FREON 11, the circuit including a two-stage heater-evaporator having a heater section 14 and an evaporator section 16, a condenser 18 which may be the usual automobile radiator and a pump 20. The heated engine coolant is delivered to the heater section 14 by a pipe 22 and flows through the heater 14 in a series of small tubes in counterflow relation with the FREON which is supplied to the heater through a conduit 24 leading from the high pressure side of the pump 20.

The pump 20 may be driven directly by the engine 10 or by a separate electric motor, not shown.

After passing through the heater 14, the engine coolant, at reduced temperature, is returned to the usual engine driven pump 26 through a conduit 28.

The heated FREON passes through the heater 14 to the evaporator 16, described in detail below, through a conduit 30 and passes through the series of small tubes in counterflow relation with the surrounding engine coolant delivered to the evaporator 16 through a conduit 32. This portion of the engine coolant then returns to the engine through conduits 34 and 28.

The FREON which exits from the evaporator 16 in a gaseous state is delivered to the motor 12 through a conduit 36 and after passing through the motor is delivered through the conduit 38 to the condenser 18.

It is a feature of the invention that because of its high efficiency, the evaporator is of extraordinarily compact construction. Accordingly, a unit sufficiently small to be accommodated under the hood of an automobile still has sufficient capacity to recover a significant amount of energy.

Figure 3:
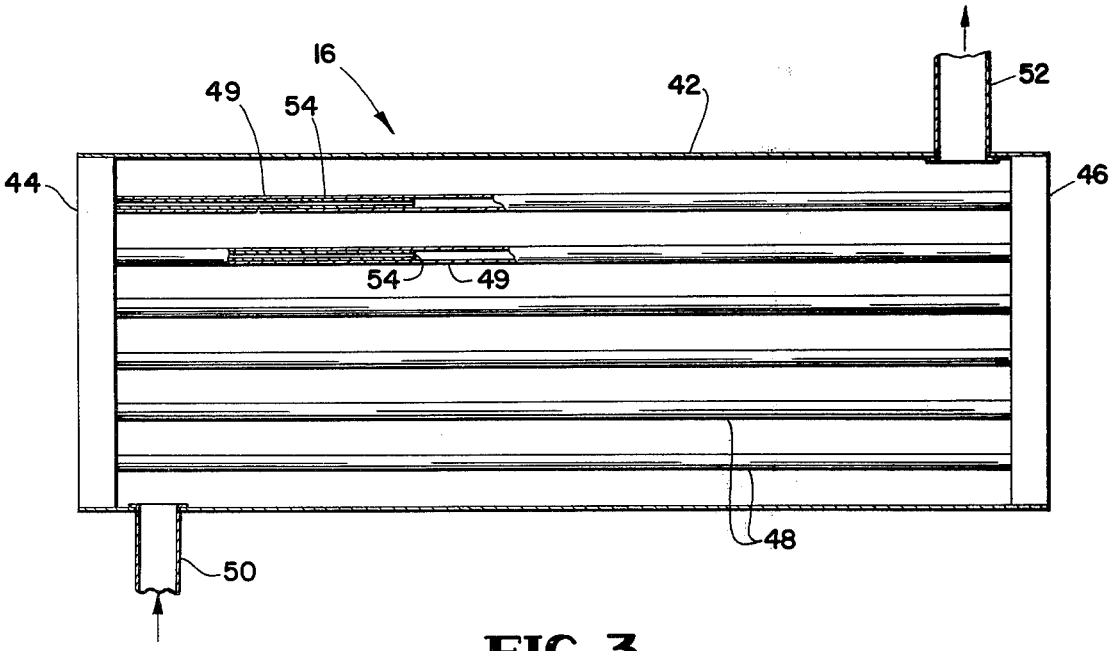
FIG. 3 is an enlarged view, partly in section, illustrating the evaporator and capillary system utililzed in the invention.

As best shown in FIG. 3, the evaporator 16 comprises an elongated cylindrical shell 42 closed at its ends by headers 44 and 46 through which the opposite ends of FREON carrying tubes 48 extend the FREON passing from right to left as viewed in FIG. 3. Inlet and outlet connections 50 and 52, respectively, are provided for the engine coolant which thus passes through the unit in counterflow relation with the FREON. In a typical case, the shell 42 is approximately 12 inches long and 2⅛ inches in diameter. A unit of this size may have 137 tubes 48 of copper or like material, tubes being ⅛ inch OD and 3/32 inch ID.

The evaporator or control section 16 incorporates a unique capillary control section which, contrary to prior practice, is positioned adjacent the outlet end of the unit. The unit is formed by a series of two or more telescoped tubes inserted one within the other. In the embodiment shown, the unit includes 37 of the main tubes 49, 12 inches long and having an OD of 3/32 inch and an ID of 1/16 inch. One shorter tube 54 which is approximately 4 inches in length and has an inside diameter of 1/32 inch is telescoped within each main tube adjacent its outlet end. Because of the position of the capillary at the outlet end of the evaporator, the refrigerant is maintained in a liquid state upstream of the capillary. Thus, throughout the major portion of the length of the evaporator, the unit functions as a high efficiency liquid-to-liquid heat exchanger. As the heated refrigerant enters the capillary control formed by the inner tubes 54, its velocity is increased and its pressure is reduced. Accordingly, the refrigerant flashes into a gaseous state in the capillary tube and is superheated.

This arrangement has proved to be adequate for handling refrigerant supplied at a pressure in the range of 100 psi. To assure proper control in systems operating at higher pressures additional flow restriction is required. This can be achieved by the insertion of one or more additional short tubes within the tubes 54. When such additional tubes are used their upstream ends are staggered to obtain progressive flow restrictions toward the outlet end of the unit.

Further improvements in efficiency are realized by the utilization of the preheater 14. Typically, this unit is 24 inches long, 2⅛ inches in diameter and contains 137 tubes (not shown) of ⅛ inch OD and 3/32 inch ID. In this unit, the engine coolant is delivered to the interior of the tubes, tubes being surrounded by the liquid refrigerant delivered by the pump 20. The provision of a relatively large number of small thin-walled tubes affords maximum practical heat exchange surface area and promotes maximum heat exchange efficiency. The tubes can be relatively thin-walled since the FREON, which is at relatively high pressure, is outside the tubes which thus need not have high bursting pressure resistance.

The unit thus far described is capable of recovering 20,000 to 40,000 BTUs per hour of useful work. Accordingly, as much as 10 horsepower can be returned to the engine through the operation of the motor 12. Since approximately 12 to 18 horsepower is required to propel a standard passenger vehicle on a level road at a constant moderate highway speed, the recapture of 10 horsepower results in a dramatic increase in overall efficiency in the engine and a corresponding decrease in fuel consumption.

The system of the present invention is also ideally suited to furnish the air conditioning to the vehicle. To this end, a conventional air conditioner evaporator 60 is connected to the output of the pump 20 through a capiallary 62. The downstream side of the evaporator is connected through a conduit 64 to a conventional engine driven compressor 66 which in turn is connected through a conduit 68 to the conduit 38 leading to the condenser 18. The air conditioning system functions in conventional manner with the exception that the compressor 66 operates against reduced head pressure thus reducing the power requirements and increasing the efficiency of the system by as much as 80% with a corresponding decrease in fuel consumption.

Figure 2:
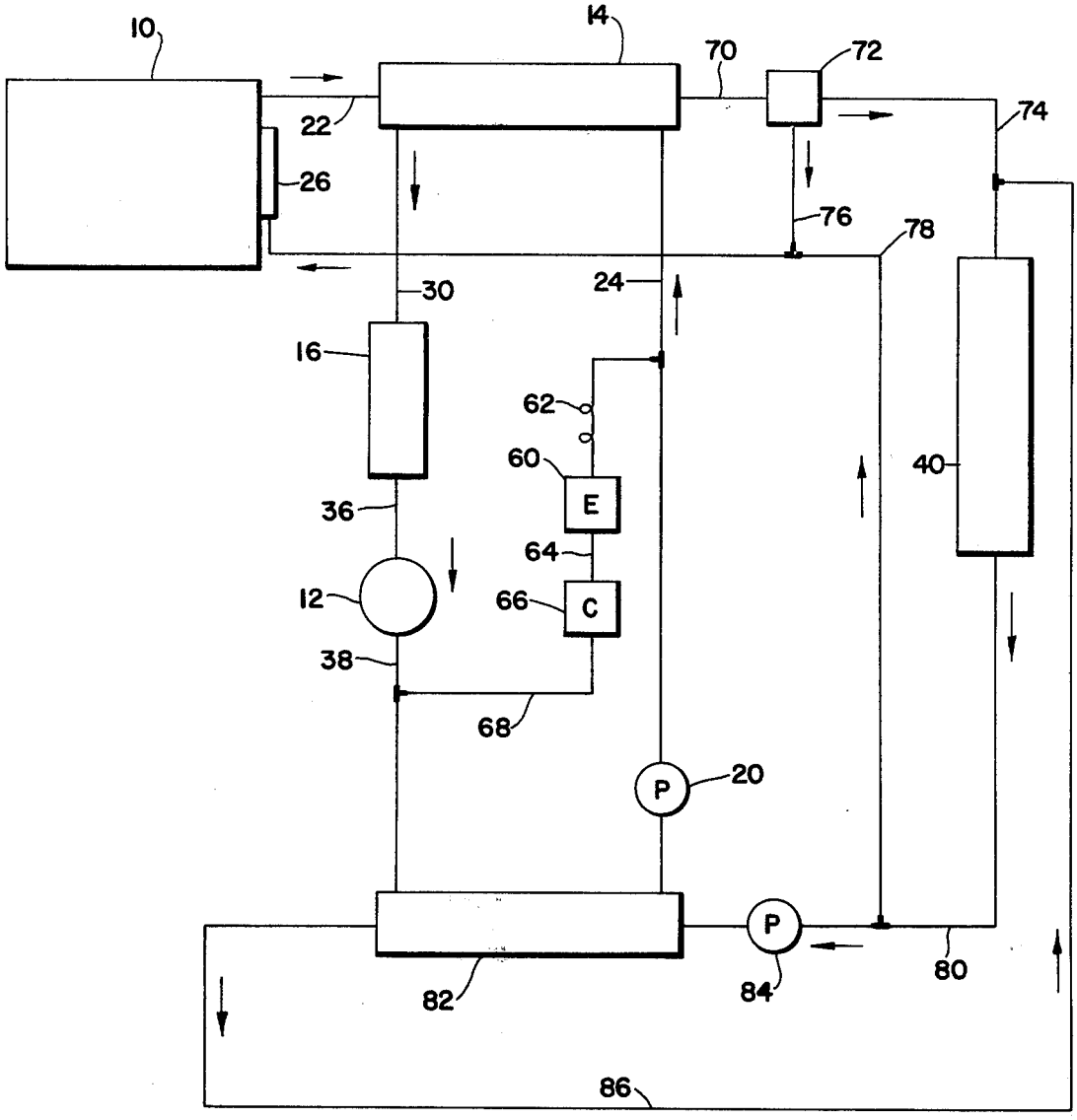
FIG. 2 is a view similar to FIG. 1 but illustrating a modification of the invention.

FIG. 2, to which detailed reference will now be made, illustrates a further embodiment of this system similar to the embodiment previously described but including additional fluid circuitry for protecting the engine 10 against overheating in the event of malfunction of a portion of the secondary system. The modified system also includes an arrangement for utilizing the exhaust heat of the engine as a power source for the secondary system. As in the previously described embodiment, the heated engine coolant is delivered through the conduit 22 to the main heat exchange 14. From the downstream side of the unit 14, the coolant is delivered through a conduit 70 to a thermostatically controlled valve 72 which delivers the coolant either through conduit 74 to the radiator 40 or through a conduit 76 to a return line 78 leading to the engine driven coolant pump 26. Normally, the valve 72 blocks flow to conduit 74 and connects conduits 70 and 76. However, in the event secondary system malfunctions or the heat exchanger 14 does not extract sufficient heat from the engine coolant, the thermostatically controlled valve 72 permits all or a portion of the coolant to pass through conduit 74 and then through the radiator 18 where additional cooling takes place. From the radiator 18, the coolant is returned to the return line 78 through a conduit 80. Thus the engine is automatically fully protected against overheating regardless of the operation of the secondary system. The evaporator unit 16 may be of the construction previously described. However, it is arranged to receive a portion of the engine exhaust gases rather than a portion of the engine coolant as in the previously described embodiment.

Finally, in this embodiment of the invention, a gas-to-liquid heat exchanger 82 is utilized as the refrigerant condenser. This unit, which may be of the same construction of the heat exchanger 14, is supplied with a portion of the engine coolant by a pump 84 which may be driven by the engine 10 or by a separate electric motor. The coolant is returned to the radiator 18 by conduit 86. It will be noted that the coolant circuit for the condenser 82 is essentially independent of the main engine coolant circuit and thus is effective regardless of the position of the thermostatic valve 72.

This embodiment of the invention also includes the air conditioning system as previously described.

I claim:

1. A secondary power system for recovering the waste heat energy of the coolant in a primary power system comprising: means forming a closed motive fluid circuit, said circuit containing motive fluid and, in series, a pump, a preheater, an evaporator, a motor and a condenser; means for passing a portion of said coolant directly from said primary system through said preheater in heat exchange relation with said motive fluid, and means for passing another portion of said coolant directly from said primary system through said evaporator in heat exchange relation with said motive fluid to vaporize said motive fluid for passage to said motor as a power source therefor.

2. A system according to claim 1 wherein said evaporator comprises a plurality of tubes through which said motive fluid passes, and a flow restrictor in each of said tubes adjacent the downstream end thereof.

3. The system according to claim 2 wherein said preheater comprises a plurality of tubes through which said coolant passes.

4. The system according to claim 1 wherein said primary power system is an internal combustion engine, together with means for returning the coolant to said internal combustion engine after passage through said preheater and said evaporator.

5. For use with an internal combustion engine having a coolant circuit including a radiator, a secondary power system for recovering the waste heat energy in said coolant, said secondary power system including a closed motive fluid circuit having, in series, a pump, a heat exchanger and a motor, means for passing said coolant through said heat exchanger in heat exchange relation with said motive fluid and means for returning said coolant to said engine including temperature response means effective when the temperature of said coolant leaving said heat exchanger exceeds a predetermined value for preventing the direct return of said coolant to said engine and for causing said coolant to pass through said radiator before return to said engine.

* * * * *

UNITED STATES PATENT AND TRADEMARK OFFICE

CERTIFICATE OF CORRECTION

PATENT NO. : 3,945,210

DATED : Mar. 23, 1976

INVENTOR(S) : Bryan W. Chapin

It is certified that error appears in the above-identified patent and that said Letters Patent are hereby corrected as shown below:

Change Assignee from "Rodina" to -- Rondina --.

* Column 1, line 40, after "is" insert -- a --.

Column 3, line 54, change "capiallary" to -- capillary --.

* Column 4, line 6, change "exchange" to -- exchanger --.

Signed and Sealed this

*twenty-ninth* Day of *June 1976*

[SEAL]

*Attest:*

RUTH C. MASON
*Attesting Officer*

C. MARSHALL DANN
*Commissioner of Patents and Trademarks*